US009458618B1

(12) United States Patent
Woznuk

(10) Patent No.: US 9,458,618 B1
(45) Date of Patent: Oct. 4, 2016

(54) PREFABRICATED WALL MODULE AND METHOD OF BUILDING A FOUNDATION WALL

(71) Applicant: Wade A. Woznuk, London (CA)

(72) Inventor: Wade A. Woznuk, London (CA)

( * ) Notice: Subject to any disclaimer, the term of this patent is extended or adjusted under 35 U.S.C. 154(b) by 0 days.

(21) Appl. No.: 14/791,551

(22) Filed: Jul. 6, 2015

(30) Foreign Application Priority Data

Apr. 10, 2015 (CA) ..... 2887768

(51) Int. Cl.
*E04B 1/00* (2006.01)
*E04B 2/58* (2006.01)
*E04B 1/24* (2006.01)

(52) U.S. Cl.
CPC ..... *E04B 1/0007* (2013.01); *E04B 1/24* (2013.01); *E04B 2/58* (2013.01); *E04B 2001/2481* (2013.01); *E04B 2103/06* (2013.01)

(58) Field of Classification Search
CPC ..... E04B 1/0007; E04B 1/24; E04B 2/58
See application file for complete search history.

(56) References Cited

U.S. PATENT DOCUMENTS 4,924,641 A * 5/1990 Gibbar, Jr. ..... E04B 2/8652 52/204.1
5,417,023 A * 5/1995 Mandish ..... E04B 2/58 52/309.14
5,535,556 A * 7/1996 Hughes, Jr. ..... E04B 1/7023 405/229
5,724,783 A * 3/1998 Mandish ..... E04B 2/58 52/144
6,047,519 A * 4/2000 Bagn ..... E04C 2/384 52/656.1
6,199,336 B1 * 3/2001 Poliquin ..... E04B 2/58 52/261
6,460,305 B1 * 10/2002 VanHaitsma ..... E02D 27/01 52/169.14
6,484,460 B2 11/2002 VanHaitsma
6,510,667 B1 * 1/2003 Cottier ..... E04B 2/8647 52/310
7,637,073 B2 * 12/2009 Elliott ..... E04B 2/7457 52/145
8,161,710 B2 * 4/2012 Elliott ..... E04B 2/7457 109/49.5
8,186,115 B2 5/2012 Harig et al.
8,726,598 B2 * 5/2014 Harding ..... B66F 9/142 52/309.4

(Continued)

FOREIGN PATENT DOCUMENTS

CA 2811981 C 3/2012
WO 01/21903 A1 3/2001

*Primary Examiner* — Andrew J Triggs
(74) *Attorney, Agent, or Firm* — Philip C. Mendes da Costa; Bereskin & Parr LLP/S.E.N.C.R.L., s.r.l.

(57) ABSTRACT

A prefabricated below-grade foundation wall module includes first and second laterally extending metal tracks, a plurality of longitudinally extending metal studs, an air barrier, and an outer structural layer. The second laterally extending metal track may be spaced from and facing the first laterally extending metal track. One end of the metal studs may be secured to the first metal track and the other end of the metal studs may be secured to the second laterally extending metal track. The air barrier may be secured in an overlaying position on an exterior-facing side of the module. The outer structural layer may be secured in an overlaying position on an exterior-facing side of the air barrier. The outer structural layer may comprise cement board, plywood or both cement board and plywood. A method of building a foundation wall is also described.

17 Claims, 4 Drawing Sheets

(56) References Cited

U.S. PATENT DOCUMENTS

| | | | | |
|---|---|---|---|---|
| 8,863,477 | B2 | 10/2014 | Stal et al. | |
| 9,200,458 | B2 * | 12/2015 | Harding | B66F 9/142 |
| 9,267,280 | B2 * | 2/2016 | Sawatzky | E04B 2/46 |
| 2001/0004818 | A1 * | 6/2001 | VanHaitsma | E02D 27/01 52/293.1 |
| 2006/0048470 | A1 * | 3/2006 | Edmondson | E04B 1/24 52/274 |
| 2006/0263575 | A1 * | 11/2006 | Ritchie | B32B 3/00 428/119 |
| 2009/0193734 | A1 | 8/2009 | Harig et al. | |
| 2012/0047834 | A1 | 3/2012 | Stal et al. | |
| 2014/0075872 | A1 * | 3/2014 | Mercado | E04B 2/58 52/309.9 |
| 2016/0040421 | A1 * | 2/2016 | Harding | B66F 9/142 52/745.2 |

* cited by examiner

PREFABRICATED WALL MODULE AND METHOD OF BUILDING A FOUNDATION WALL

FIELD

This disclosure relates to the field of prefabricated wall modules and methods of building a foundation wall.

INTRODUCTION

Many structures, such as residential, commercial, and industrial buildings have a foundation that forms the base of the building. Traditionally, a foundation is formed by pouring a concrete footer and then using cinder blocks to build up a surrounding foundation wall. In other cases, wall forms are assembled on the footer and the walls for formed by pouring concrete therein.

SUMMARY

This summary is intended to introduce the reader to the more detailed description that follows and not to limit or define any claimed or as yet unclaimed invention. One or more inventions may reside in any combination or sub-combination of the elements or process steps disclosed in any part of this document including its claims and figures.

According to one broad aspect, a prefabricated below-grade foundation wall module is provided. The module utilizes a metal frame. On one side, which is the exterior side when the module is positioned on a foundation, an air barrier and an exterior cladding layer is provided. A water resistance coating may also be provided. Accordingly, in use, the module may be placed on a foundation wall and secured thereto. A water proofing material may be applied at the juncture of the module and the footer. Accordingly, the air barrier, the outer cladding and the water resistance coating may be applied at a fabrication side (e.g., in a factory) such that the module is constructed under controlled conditions, (e.g., room temperature and standard humidity). An advantage of this construction technique is that the module may be built to a higher quality standard than if the wall was built in the field. For example, at a construction site, the wall might be built while or after it has been raining and therefore the cladding might be damp when applied or when a water resistance coating is applied thereto.

In accordance with this aspect, a foundation wall module may comprise first and second laterally extending metal tracks, a plurality of longitudinally extending metal studs, an air barrier, and an outer structural layer or outer cladding. The first laterally extending metal track may have first and second laterally opposed ends. The second laterally extending metal track may be spaced from and facing the first laterally extending metal track and may have first and second laterally opposed ends. The plurality of longitudinally extending metal studs may have first and second opposed ends. The first ends may be secured to the first laterally extending metal track and the second ends may be secured to the second laterally extending metal track. In use, the metal studs may be oriented vertically. Two laterally outwardly positioned metal studs and the first and second metal tracks may define an outer frame of the module. Each metal stud may have an interior-facing side, which in use is positioned on an interior of a building and an exterior-facing side. The module may have an interior-facing side and an outer-facing side. The air barrier may be secured in an overlaying position on the exterior-facing side of the module. The outer structural layer may be secured in an overlaying position on an exterior-facing side of the air barrier. The outer structural layer may comprise cement board, plywood or both cement board and plywood.

In some embodiments, the prefabricated wall module may further comprise a water resistance coating provided on an outer face of the outer structural layer.

In some embodiments, the outer structural layer may comprise a plurality of panels of cement board and/or plywood and a water resistant seal is provided between abutting panels.

In some embodiments, in use, a lower portion of the module may be located below-grade and may be provided with a first portion of the outer structural layer, and an upper portion may be located above-grade and may be provided with a second portion of the outer structural layer, and the first portion of the outer structural layer may comprise at least one plywood panel. An advantage of this design is that the below grade portion of the module may be constructed without using cement board as the outer cladding layer.

In some embodiments, the second portion of the outer structural layer may comprise the at least one cement board panel.

In some embodiments, the plurality of metal studs may be laterally spaced apart between 12 and 24 inches on center.

In some embodiments, a first metal stud may be located adjacent the first ends of the first and second metal tracks and a second metal stud may be located adjacent the second ends of the first and second metal tracks.

In some embodiments, each of the first and second metal tracks may comprise a C-channel.

In some embodiments, a plurality of openings may be provided in the metal studs. For example, each metal stud may have at least one opening provided therein. Alternately, each metal stud may have a plurality of openings provided therein. An advantage of this design is that the metal studs may be provided with openings through which conduits (e.g., for plumbing) and wiring may be run. Accordingly, once installed, the module is ready for the interior to be completed without any modification (e.g., drilling, etc.) of the studs.

According to another broad aspect, a method of building a foundation wall is provided. According to this method, a plurality of the modules according to any embodiment disclosed herein may be assembled together to form a foundation wall. A water proofing material may then be applied to a juncture of the modules (e.g., the vertical seam between two adjacent modules) and a water proofing material may be applied at a juncture of the bottom of the modules and the footer of the foundation. Wires and/or fluid conduits may be run through the studs (preferably through openings that are pre-formed in the studs of the modules). Insulation may then be installed between the studs and drywall applied to an inner face of the studs. An advantage of this design is that a frame wall need not be constructed inside the foundation wall. Instead, the studs of the foundation wall may be used build the interior wall and house the wiring and plumbing for the utilities.

In accordance with this aspect, the method may comprise providing a plurality of the prefabricated wall modules; providing a footing extending around at least a portion of the foundation, the footing having a C-channel secured thereto and a waterproofing membrane positioned between the C-channel and the footing; securing a plurality of prefabricated wall modules in the C-channel and securing adjacent wall-modules to each other; applying a waterproofing material at a juncture of abutting prefabricated wall modules;

and, applying a waterproofing material to an outer surface of the modules and an outer surface of the footing at a juncture of the modules and the footing.

In some embodiments, at least a portion of an outer face of the modules may be located below grade and the method may further comprise applying a water resistance coating on the portion of the outer face of the modules that is located below grade.

In some embodiments, a portion of an outer structural layer of the modules may comprise at least one plywood panel and the method may further comprise positioning the at least one plywood panel at a lower end of the module whereby at least some of the at least one plywood panel is located below grade.

In some embodiments, the method may further comprise securing drywall panels on the inner-facing side of the modules.

In some embodiments, the method may further comprise positioning insulation between adjacent pairs of metal studs prior to securing drywall panels on the inner-facing side of the modules.

In some embodiments, each metal stud may have at least one opening provided therein and the method may further comprise installing wiring and/or plumbing in the foundation wall by extending the wiring and/or plumbing through the openings.

DRAWINGS

The drawings included herewith are for illustrating various examples of articles, methods, and apparatuses of the teaching of the present specification and are not intended to limit the scope of what is taught in any way.

DESCRIPTION OF VARIOUS EMBODIMENTS

Numerous embodiments are described in this application, and are presented for illustrative purposes only. The described embodiments are not intended to be limiting in any sense. The invention is widely applicable to numerous embodiments, as is readily apparent from the disclosure herein. Those skilled in the art will recognize that the present invention may be practiced with modification and alteration without departing from the teachings disclosed herein. Although particular features of the present invention may be described with reference to one or more particular embodiments or figures, it should be understood that such features are not limited to usage in the one or more particular embodiments or figures with reference to which they are described.

The terms "an embodiment," "embodiment," "embodiments," "the embodiment," "the embodiments," "one or more embodiments," "some embodiments," and "one embodiment" mean "one or more (but not all) embodiments of the present invention(s)," unless expressly specified otherwise.

The terms "including," "comprising" and variations thereof mean "including but not limited to," unless expressly specified otherwise. A listing of items does not imply that any or all of the items are mutually exclusive, unless expressly specified otherwise. The terms "a," "an" and "the" mean "one or more," unless expressly specified otherwise.

As used herein and in the claims, two or more parts are said to be "coupled", "connected", "attached", or "fastened" where the parts are joined or operate together either directly or indirectly (i.e., through one or more intermediate parts), so long as a link occurs. As used herein and in the claims, two or more parts are said to be "directly coupled", "directly connected", "directly attached", or "directly fastened" where the parts are connected in physical contact with each other. As used herein, two or more parts are said to be "rigidly coupled", "rigidly connected", "rigidly attached", or "rigidly fastened" where the parts are coupled so as to move as one while maintaining a constant orientation relative to each other. None of the terms "coupled", "connected", "attached", and "fastened" distinguish the manner in which two or more parts are joined together.

Figure 1:
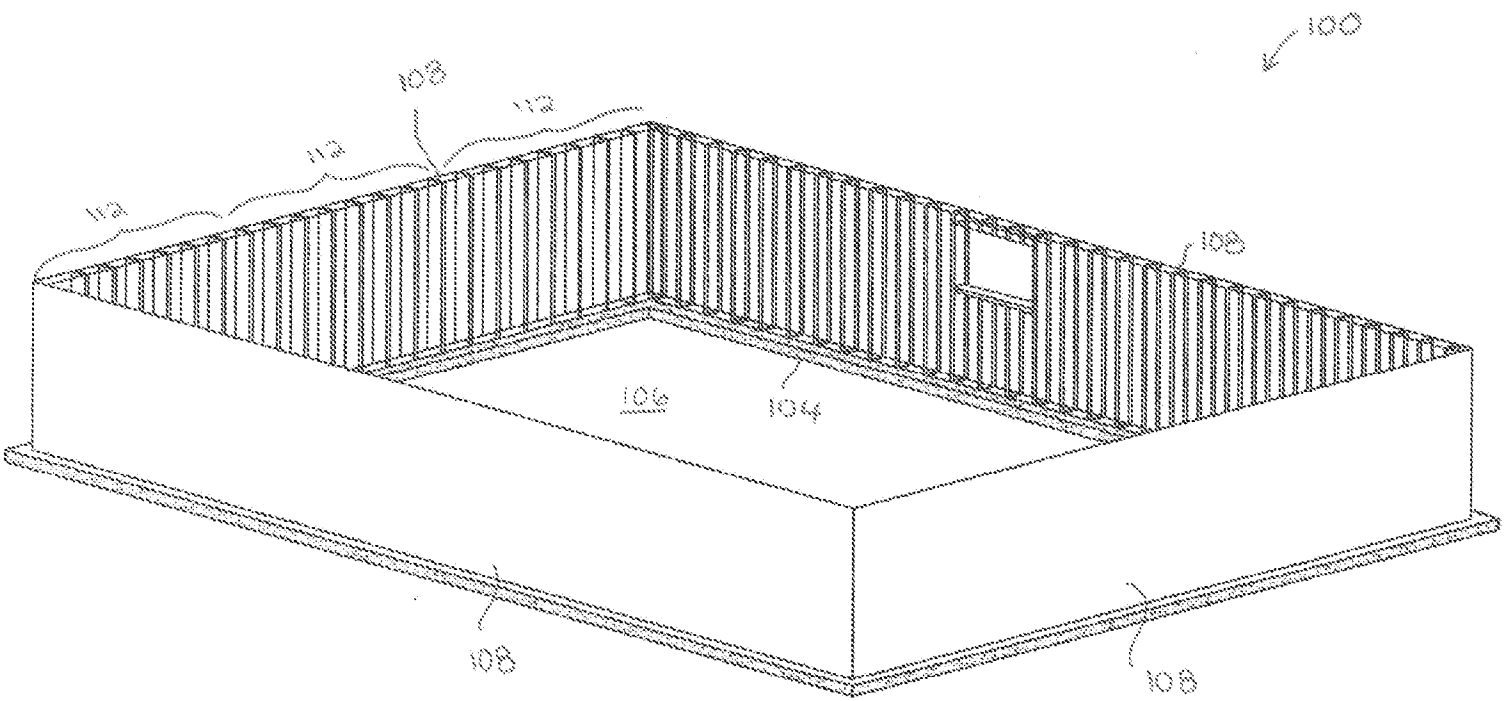
FIG. 1 is a perspective view of a foundation in accordance with at least one embodiment.

FIG. 1 exemplifies a foundation 100 in accordance with at least one embodiment. In some embodiments, foundation 100 may be the lowermost floor of a structure, such as a residential, commercial, or industrial building. Foundation 100 may be positioned at least partially below-grade, e.g. to provide a basement floor of the structure. For example, foundation 100 may be built inside a foundation pit.

As shown, foundation 100 may include a foundation footing 104, and a plurality of interconnected foundation walls 108 which stand upright on foundation footing 104 to define an enclosed basement area 106. Foundation walls 108 may provide structural support for walls and flooring of the structure above, resist inward loads of the surrounding dirt, and resist ingress of outside gases and liquids. Foundation footing 104 may be any suitable foundation footing known in the art. For example, foundation footing 104 may comprise poured concrete and a footing track 212. Foundation footing 104 may be located at the bottom of any building construction site and, depending upon the depth of foundation footing 104, foundation walls 108 may be partially or fully below grade.

Each foundation wall 108 may comprise a plurality of prefabricated wall modules 112. As shown, prefabricated wall modules 112 may be positioned side-by-side and fastened to foundation footing 104 to form contiguous foundation walls 108 along the perimeter of foundation footing 104.

Prefabricated wall modules 112 may be manufactured off-site (e.g. as a retail product). For example, they may be manufactured in a building under controlled conditions. Accordingly, on advantage of this design is that prefabricated wall modules 112 may permit foundation walls 108 to be erected more quickly compared with traditional techniques of building foundation walls 108 which typically involves waiting periods for components (e.g. mortar) to dry. Further, prefabricated wall modules 112 may be installed in weather conditions (e.g. forecast of rain) that might otherwise dictate a delay for traditional techniques. Further, prefabricated wall modules 112 may be constructed at an off-site facility by specialized equipment and staff. This may provide prefabricated wall modules 112 with better quality, performance, and consistency than analogous components constructed on-site by traditional techniques. This may also permit foundation walls 108 to be erected on-site by fewer and less skilled laborers because most components of the foundation walls 108 are pre-constructed off-site in the prefabricated wall modules 112. Further, prefabricated wall modules 112 may generate less waste on-site, which may reduce clean-up time after the foundation construction is complete.

Figure 2:
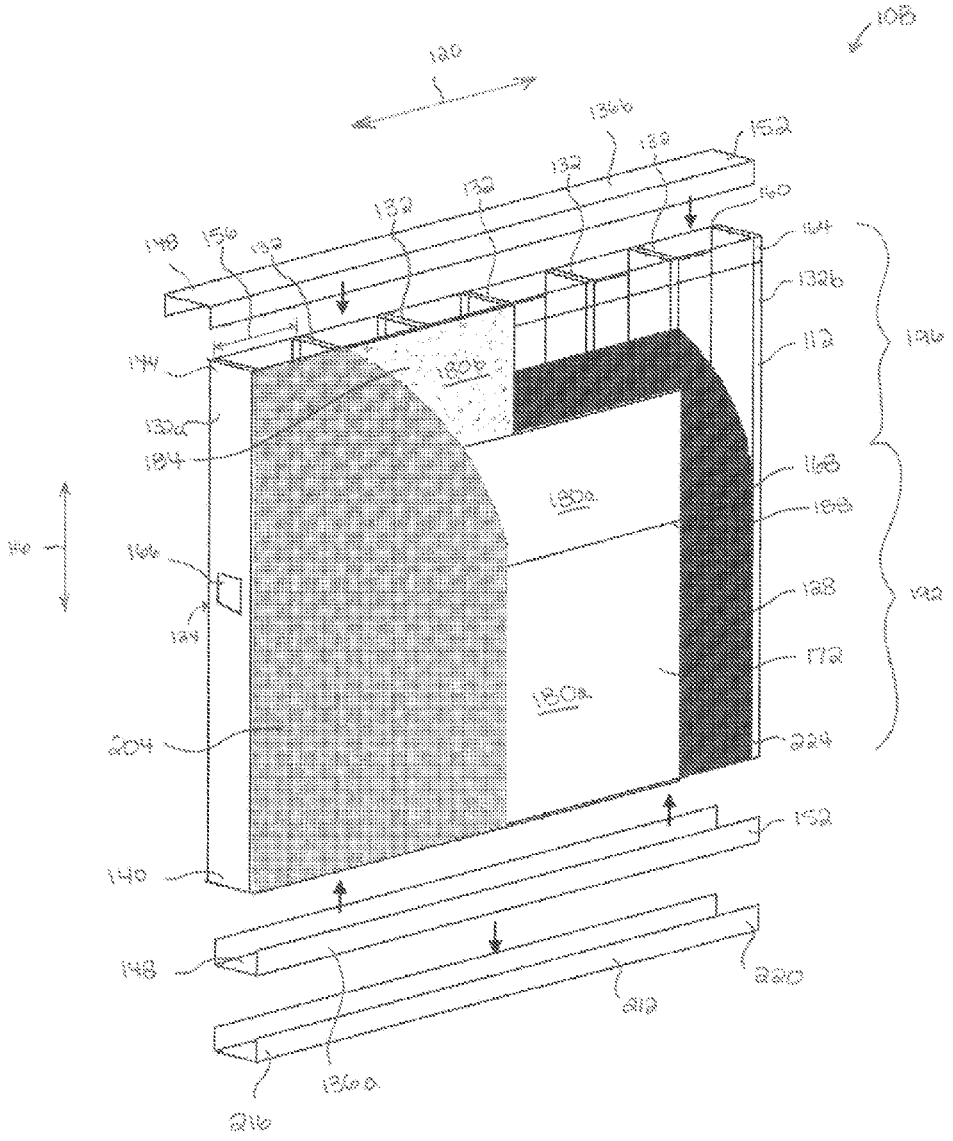
FIG. 2 is an exploded perspective view of a foundation wall including a prefabricated wall module, in accordance with at least one embodiment.

FIG. 2 exemplifies a length of foundation wall 108 including a prefabricated wall module 112. As shown, prefabricated wall module 112 has a longitudinal direction 116, and a lateral direction 120. In use, prefabricated wall module 112 may be fastened to foundation footing 104 with longitudinal direction 116 oriented substantially normal to foundation footing 104 (e.g. vertically) and lateral direction 120 oriented substantially parallel to foundation footing 104 (e.g. horizontally).

Prefabricated wall module 112 has an interior facing module side 124 and an exterior facing module side 128. As shown in FIG. 1, interior facing module side 124 may face toward an inside of the structure (e.g. into basement area 106), and exterior facing module side 128 may face toward an exterior of the structure (e.g. away from basement area 106).

Turning to FIG. 2, prefabricated wall module 112 may include a plurality of longitudinally extending metal studs 132 held together by laterally extending metal tracks 136. Each metal stud 132 may extend longitudinally from a first stud end 140 to a second stud end 144. Each metal track 136 may extend laterally from a first track end 148 to a second track end 152. Laterally extending metal track 136*a* is spaced from and faces laterally extending metal track 136*b* such that metal studs 132 may be secured therebetween. As shown, the first stud end 140 of each metal stud 132 may be secured to first metal track 136*a*, and the second stud end 144 of each metal stud 132 may be secured to a second metal track 136*b*.

Still referring to FIG. 2, metal studs 132 may be distributed across the lateral direction 120 of prefabricated wall module 112. As exemplified, each metal stud 132 may be positioned in spaced apart relation to each other metal stud 132. In some embodiments, metal studs 132 may be oriented parallel to each other metal stud 132. In some embodiments, each metal stud 132 may be laterally spaced apart from each adjacent metal stud 132 by the same lateral stud spacing 156 (measured center to center). In alternative embodiments, one or more metal studs 132 may be oriented non-parallel to other metal studs 132, and/or the lateral stud spacing 156 may differ between different adjacent metal studs 132.

Metal studs 132 may be spaced apart by any suitable lateral stud spacing 156. In some embodiments, lateral stud spacing 156 may correspond to standard widths of building materials (e.g. wall boards, plastic sheets, insulation, etc.). For example, lateral stud spacing 156 may be between 12 and 24 inches, such as 16 inches on centre. As shown, metal studs 132 include an interior facing stud side 160 and an exterior facing stud side 164.

Metal studs 132 may be secured to metal tracks 136 in any suitable fashion, such as by mechanical fasteners (e.g. rivets, screws, or bolts), welds, or by integrally forming metal studs 132 and metal tracks 136, for example. Metal tracks 136 may take any suitable form. In the illustrated example, metal tracks 136 are sized and shaped to receive a stud end 140 or 144 of a metal stud 132. As shown, metal tracks 136 may be formed as C-channels having a C-shaped cross-section when viewed from a lateral track end 148 or 152. First and second metal tracks 136*a* and 136*b* may be longitudinally opposed and oriented to face each other for receiving first and second stud ends 140 and 144 respectively.

Prefabricated wall module 112 includes laterally outermost metal studs 132*a* and 132*b*, which in combination with first and second metal tracks 136*a* and 136*b* form an outer frame of prefabricated wall module 112. As shown, laterally outermost metal stud 132*a* is positioned adjacent first track ends 148 of metal tracks 136*a* and 136*b*, and laterally outermost metal stud 132*b* is positioned adjacent second track ends 152 of metal tracks 136*a* and 136*b*.

Still referring to FIG. 2, metal stud 132 may include one or a plurality of stud openings 166 for providing lateral passage through prefabricated wall module 112 for plumbing, wiring, and the like. Alternatively, or in addition, stud opening 166 may facilitate carrying the prefabricated wall module 112 (e.g. by hand or by a lifting tool with a hook inserted into the stud opening 166). As shown, stud opening 166 may be formed in a lateral facing stud side 167 of metal stud 132. One or more stud openings 166 may be formed in one or more of the metal studs 132 of prefabricated wall module 112. For example, every one of the metal studs 132 of prefabricated wall module 112 may have one or a plurality of stud openings 166. Stud openings 166 may have any suitable size and shape and may be at any location. In some embodiments, stud openings 166 are sized and shaped to receive plumbing (e.g. water or gas pipes), to receive wiring, and/or to receive a hand or a hook of a lifting tool. Optionally, the openings on each stud of a module are located as the same distance or distances from track 136*a*.

Figure 3:
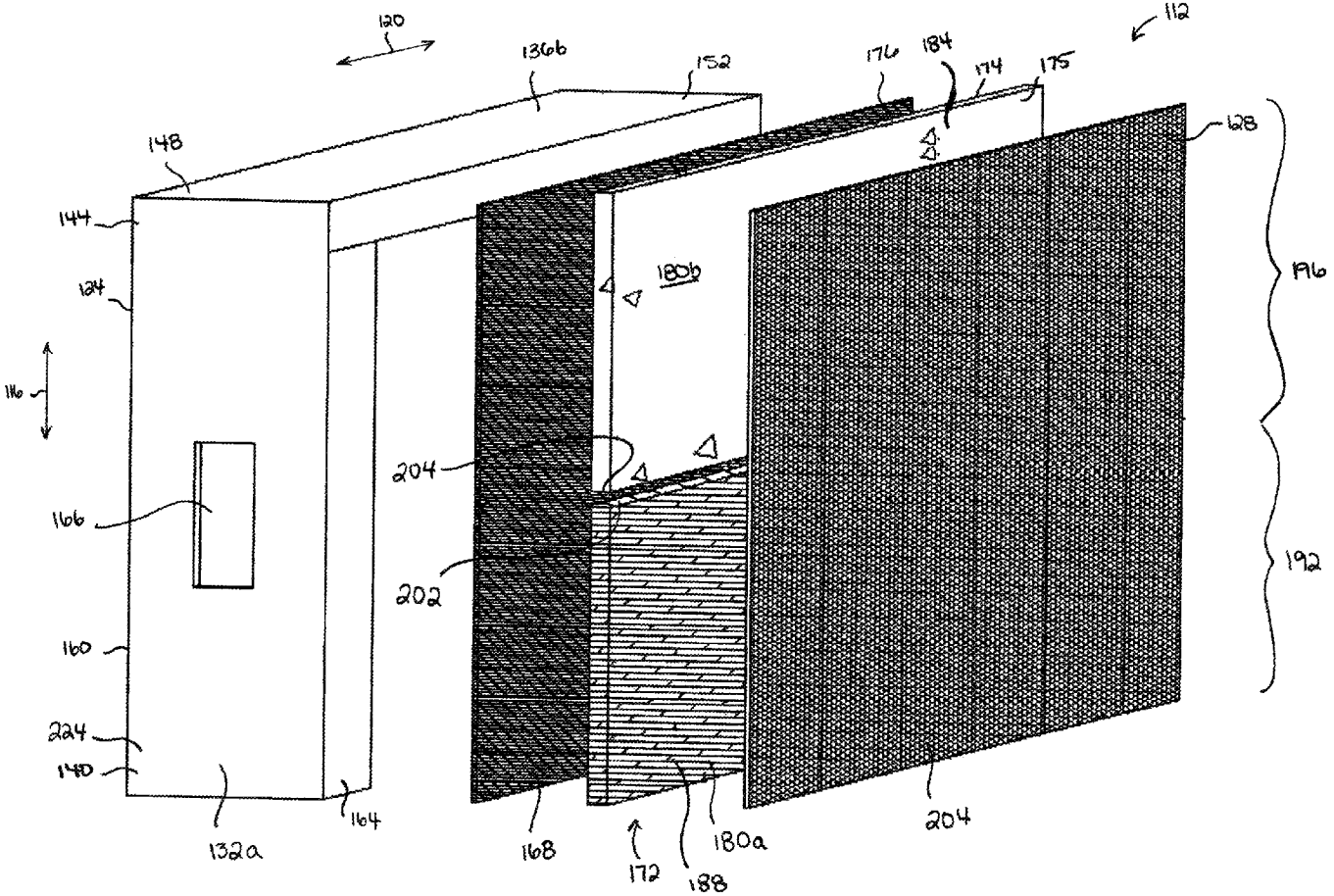
FIG. 3 is an exploded perspective view of a prefabricated wall module, in accordance with at least one embodiment; and, FIG. 4 is a flowchart illustrating a method of building a foundation wall, in accordance with at least one embodiment.

Referring now to FIGS. 2 and 3, prefabricated wall module 112 may include an air barrier to inhibit passage of air in a direction transverse to the plane of the outer-facing side of prefabricated wall module 112 into the structure. This may protect the structure from moisture laden air, as well as airborne pollutants such as pollens, suspended particulates, and odors for the comfort and safety of the structure occupants. In the illustrated example, prefabricated wall module 112 includes an air barrier 168 secured overlaying exterior facing module side 128. For example, air barrier 168 may be secured in contact with exterior facing stud side 164. In some cases, this may permit air barrier 168 to protect insulation placed between metal studs 132 from moist air which may form mold if absorbed by the insulation. Preferably, air barrier 168 extends in the longitudinal and lateral directions 116 and 120 to cover substantially the entire exterior facing module side 128 or all of exterior facing module side 128.

Air barrier 168 may be any suitable air barrier known in the art. For example, air barrier 168 may be a flexible plastic sheet such as a Dupont™ Tyvek® air barrier or similar. Air barrier 168 may be secured to exterior facing module side 128 (e.g. to exterior facing stud side 164) in any suitable fashion, such as by mechanical fasteners (e.g. rivets, screws, bolts, or staples), tape, or adhesives. In alternative embodiments, prefabricated wall module 112 does not include an air barrier 168.

Still referring to FIGS. 2 and 3, prefabricated wall module 112 may include a structural layer or cladding secured to exterior facing module side 128 for resisting inward loads by the dirt surrounding prefabricated wall module 112 when installed below grade. In the illustrated example, prefabricated wall module 112 includes outer structural layer 172 secured overlaying exterior facing air barrier side 176. For example, outer structural layer 172 may comprise one or more rigid building panels secured to metal studs 132.

Outer structural layer 172 may be secured in position in any suitable fashion. For example, outer structural layer 172 may be secured in position overlaying exterior facing air barrier side 176 by mechanical fasteners (e.g. rivets, screws, bolts, or staples), tape, or adhesive. In some embodiments, outer structural layer 172 may be integrally formed with air barrier 168. In some embodiments, outer structural layer 172 may be fastened in contact with exterior facing stud side 164. For example, outer structural layer 172 may be positioned interiorly of air barrier 168, or prefabricated wall module 112 may be absent an air barrier 168. Preferably, outer structural layer 172 extends in the longitudinal and lateral directions 116 and 120 to cover substantially the entire exterior facing module side 128 or all of exterior facing module side 128.

Outer structural layer 172 may be formed by one or more rigid building panels 180. Building panels 180 may require sufficient rigidity to resist inward loads by the surrounding dirt. Preferably, building panels 180 are cost-effective, and substantially lightweight for ease of transportation and installation. In some embodiments, outer structural layer 172 comprises one or more plywood panels 180*a* and/or cement board panels 180*b*, each of which may provide sufficient rigidity to resist the inward loading of the surrounding dirt. Accordingly, a single building panel 180 may overlie a module 112. Alternately a plurality of building panels 180 may be provided on exterior facing module side 128. In some embodiments, a single layer of building panels 180 may be provided and in other embodiments a plurality of layers of building panels 180 may be provided. Each layer of building panels 180 may be made of the same or different materials. As shown, outer structural layer 172 comprises a single layer of building panels 180 and includes an interior facing structural layer side 174 and an exterior facing structural layer side 175.

In some cases, plywood may be less expensive and more rigid than cement board. However, cement board may be more suitable as above-grade sheathing for some applications such as stucco coating. In the illustrated example, outer structural layer 172 comprises a plurality of building panels 180 including at least one plywood panel 180*a* and at least one cement board panel 180*b*. Plywood panel 180*a* may be any suitable plywood panel. Cement board panel 180*b* may be any suitable cement board panel. For example, cement board panel 180*b* may be a USG Structo-Crete® structural concrete panel. Building panels 180 may be arranged side-by-side to overlay all or substantially the entirety of exterior facing module side 128.

As shown, outer structural layer 172 may include a first structural layer portion 184 including at least one plywood panel 180*a*, and a second structural layer portion 188 include at least one cement board panel 180*b*. First and second structural layer portions 184 and 188 may be longitudinally arranged in prefabricated wall module 112, and oriented so that in use first structural layer portion 184 extends below-grade and second structural layer portion 188 extends above-grade. As shown, plywood panel 180*a* may include a perimeter having an end face 202, and cement board panel 180*b* may include a perimeter having an end face 204 abutting end face 202. For example, prefabricated wall module 112 may include a lower module portion 192 including the first structural layer portion 184, and an upper module portion 196 including the second structural layer portion 188. In use, lower module portion 192 may be positioned below-grade, and upper module portion 196 may be positioned above-grade. This may provide at least one cement board panel 180*b* which extends above-grade (e.g. for stucco coating), and at least one plywood panel 180*a* which extends below-grade (e.g. for enhanced rigidity and cost-effectiveness). It will be appreciated that the juncture of panel 180*a, b* may be varied and may be designed such that the juncture is proximate the level of grade of a building. Therefore, in some cases, the modules 112 may be custom designed such that a wood cladding is provided below grade and, optionally, slightly above grade (e.g., 1-2 feet) and a cladding suitable for, e.g., having stucco applied thereto (or a USG Structo-Crete® structural concrete panel), is provided above grade.

A water resistant coating may be applied to outer structural layer 172 to resist passage of water (e.g. from rain or melting snow) through prefabricated wall module 112 into the structure. In some embodiments, e.g., where outer structural layer 172 comprises a single layer of building panels 180, a water resistant coating may be provided at the juncture of abutting building panels 180. The water resistant coating 204 may take any suitable form, such as a spray-on coating, or an overlaid sheet. For example, water resistant coating 204 may be a sheet of Delta®-Thene 40 self-adhering waterproofing membrane overlaying the entire exterior facing structural layer side 175. In some embodiments, a water resistant coating 204 may be applied to all or essentially all of exterior facing structural layer side 175 or it may be applied only in the vicinity of the juncture of abutting building panels 180.

Figure 4:
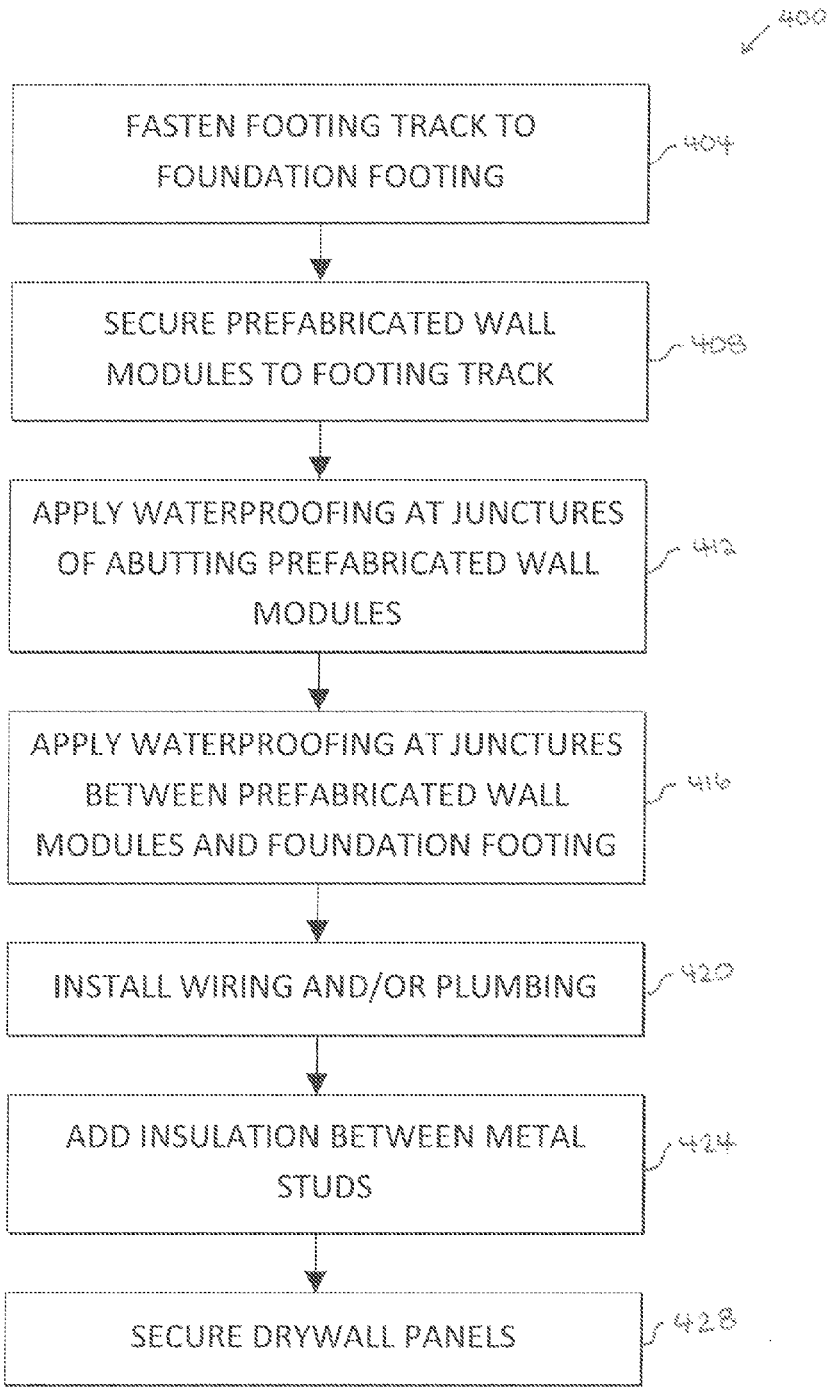

Reference is now made to FIGS. 1, 2, and 4. FIG. 4 exemplifies a flowchart illustrating a method 400 of building a foundation wall 108. A foundation footing 104 is provided. Step 404 may comprise securing a footing track 212 (FIG. 2) to foundation footing 104 (FIG. 1) which extends around at least a portion of foundation 100. Referring to FIG. 2, footing track 212 may take any suitable form. For example, footing track 212 may be sized and shaped to receive the first metal track 136*a* of a prefabricated wall module 112. In the illustrated example, footing track 212 extends laterally from a first footing track end 216 to a second footing track end 220, and is formed as a C-channel having a C-shaped cross-section when viewed in profile from either of the footing track ends 216 or 220.

Referring to FIGS. 1 and 2, footing track 212 may be formed as one or more C-channels arranged along foundation footing 104 for holding the plurality of prefabricated wall modules 112 of the foundation wall 108. Footing track 212 may be secured to foundation footing 104 in any suitable fashion, such as by mechanical fasteners (e.g. screws, bolts, or rivets), welding, or concrete, for example.

In some embodiments, a waterproofing membrane may be positioned between footing track 212 and foundation footing 104 for resisting capillary wicking of water and upward migration of moisture from foundation footing 104 into foundation wall 108. Any suitable waterproofing membrane may be provided, such as Delta® Footing Barrier for example.

Step 408 may comprise securing a plurality of prefabricated wall modules 112 to footing track 212. Prefabricated wall modules 112 may be secured to footing track 212 in any suitable manner. For example, wall modules 112 may be positioned laterally side-by-side in abutting relation with metal tracks 136*b* received in footing track 212. Metal tracks 136*b* may be rigidly connected to footing tracks 212 by mechanical fasteners (e.g. screws, bolts, or rivets) or by welds, for example.

In some embodiments, the prefabricated wall modules 112 may be positioned partially or completely below-grade. For example, prefabricated wall modules 112 may include a lower module portion 192 located below-grade. The prefabricated wall modules 112 may also extend above-grade, and in that case the prefabricated wall modules 112 will include an upper module portion 196 located above-grade. A waterproofing coating 204 may be applied to the lower module portion 192 or both the lower and upper module portions 192 and 196. The outer structural layer 172 in the lower module portion 192 may include at least one plywood building panel 180*a* which extends partially or entirely below-grade. For example, the plywood building panel 180*a* may be positioned at a lower module end 224 of the prefabricated wall module 112.

Step 412 may comprise applying a waterproofing material at the junctions of abutting prefabricated wall modules 112. The waterproofing material may take any suitable form, such as a spray-on coating, or overlaid tape for example.

Step 416 may comprise applying a waterproofing material at the junctures between the prefabricated wall modules 112 and the foundation footing 104. For example, the waterproofing material may be applied to exterior facing module side 128 and an exterior facing side of foundation footing 104 at the junctures between the prefabricated wall modules 112 and the foundation footing 104. This waterproofing material may resist water penetration into the structure at the junctures between the prefabricated wall modules 112 and the foundation footing 104. The waterproofing material may take any suitable form, such as a spray-on coating, or an overlaid tape for example.

Step 420 may comprise installing wiring and/or plumbing in the foundation walls 108. For example, wiring cables and/or plumbing pipes may be extended laterally through one or more stud openings 166 of one or more metal studs 132 of prefabricated wall modules 112.

Step 424 may comprise applying insulation to foundation walls 108. For example, the insulation may be positioned between adjacent metal studs 132 of the prefabricated wall modules 112, preferably subsequent to the installation of the wiring and plumbing. The insulation may be of any suitable type, such as batt-type (e.g. fiberglass or mineral wool), loose-fill (e.g. fiberglass, or mineral fiber), rigid board (e.g. polystyrene, rigid fiberglass, or rigid mineral fiber), or spray-type (e.g. wet-spray cellulose, or polyurethane).

Step 428 may comprise securing drywall panels to the interior facing module side 124 of prefabricated wall modules 112. In some embodiments, drywall panels may be secured in contact with interior facing stud sides 160 of metal studs 132. For example, drywall panels may be secured to interior facing stud sides 160 with conventional metal drywall screws, or in any other suitable fashion such as by other mechanical fasteners (e.g. rivets, screws, bolts, or staples), or adhesives. In some embodiments, lateral stud spacing 156 corresponds to widely available drywall board widths (e.g. 16 inches) to reduce the amount of drywall cutting required.

While the above description provides examples of the embodiments, it will be appreciated that some features and/or functions of the described embodiments are susceptible to modification without departing from the spirit and principles of operation of the described embodiments. Accordingly, what has been described above has been intended to be illustrative of the invention and non-limiting and it will be understood by persons skilled in the art that other variants and modifications may be made without departing from the scope of the invention as defined in the claims appended hereto. The scope of the claims should not be limited by the preferred embodiments and examples, but should be given the broadest interpretation consistent with the description as a whole.

The invention claimed is:

1. A prefabricated below-grade foundation wall module comprising:

a) a first laterally extending metal track having first and second laterally opposed ends;

b) a second laterally extending metal track spaced from and facing the first laterally extending metal track and having first and second laterally opposed ends;

c) a plurality of longitudinally extending metal studs having first and second opposed ends, the first ends secured to the first laterally extending metal track and the second ends secured to the second laterally extending metal track wherein, in use, the metal studs are oriented vertically, wherein two laterally outwardly positioned metal studs and the first and second metal tracks define an outer frame of the module, each metal stud having an interior-facing side, which in use is positioned on an interior of a building and an exterior-facing side and the module having an interior-facing side and an outer-facing side;

d) an air barrier secured in an overlaying position on the exterior-facing side of the module; and, e) an outer structural layer secured in an overlaying position on an exterior-facing side of the air barrier wherein the outer structural layer comprises a cement board panel and a plywood panel, wherein each of the cement board panel and the plywood panel comprises a perimeter having an end face, and the end face of the cement board panel abuts the end face of the plywood panel and a water resistant seal is provided at the end faces of the cement board panel and the plywood panel.

2. The prefabricated wall module of claim 1 further comprising a water resistance coating provided on an outer face of the outer structural layer.

3. The prefabricated wall module of claim 1, wherein, in use, a lower portion of the module is located below-grade and is provided with a first portion of the outer structural layer, and an upper portion is located above-grade and is provided with a second portion of the outer structural layer, and the first portion of the outer structural layer comprises the plywood panel.

4. The prefabricated wall module of claim 3, wherein the second portion of the outer structural layer comprises the cement board panel.

5. The prefabricated wall module of claim 1, wherein the plurality of metal studs are laterally spaced apart between 12 and 24 inches on center.

6. The prefabricated wall module of claim 1, wherein a first metal stud is located adjacent the first ends of the first and second metal tracks and a second metal stud is located adjacent the second ends of the first and second metal tracks.

7. The prefabricated wall module of claim 1, wherein each of the first and second metal tracks comprises a C-channel.

8. The prefabricated wall module of claim 1, wherein a plurality of openings are provided in the metal studs.

9. The prefabricated wall module of claim 1, wherein each metal stud has at least one opening provided therein.

10. The prefabricated wall module of claim 1, wherein each metal stud has a plurality of openings provided therein.

11. A method of building a foundation wall comprising:

a) providing a plurality of the prefabricated wall modules of claim 1, b) providing a footing extending around at least a portion of the foundation, the footing having a C-channel secured thereto and a waterproofing membrane positioned between the C-channel and the footing;

c) securing a plurality of prefabricated wall modules in the C-channel and securing adjacent wall-modules to each other;

d) applying a waterproofing material at a juncture of abutting prefabricated wall modules; and, e) applying a waterproofing material to an outer surface of the modules and an outer surface of the footing at a juncture of the modules and the footing.

12. The method of claim 11, wherein at least a portion of an outer face of the modules is located below grade and the method further comprises applying a water resistance coating on the portion of the outer face of the modules that is located below grade.

13. The method of claim 12, further comprising positioning the plywood panel of each module at a lower end of the module whereby at least some of the plywood panel is located below grade.

14. The method of claim 11 further comprising securing drywall panels on the inner-facing side of the modules.

15. The method of claim 14, further comprising positioning insulation between adjacent pairs of metal studs prior to securing drywall panels on the inner-facing side of the modules.

16. The method of claim 14, wherein each metal stud has at least one opening provided therein and the method further comprises installing wiring and/or plumbing in the foundation wall by extending the wiring and/or plumbing through the openings.

17. The method of claim 11, further comprising positioning the plurality of wall modules with at least a portion of the plywood panel of each module located below grade, and with at least a portion of the cement board panel of each module located above grade.

* * * * *